United States Patent [19]

Zuliani et al.

[11] Patent Number: 5,041,160

[45] Date of Patent: Aug. 20, 1991

[54] MAGNESIUM-CALCIUM ALLOYS FOR DEBISMUTHIZING LEAD

[75] Inventors: Douglas J. Zuliani, Stittsville; Bernard Closset, Toronto, both of Canada

[73] Assignee: Timminco Limited, Ontario, Canada

[21] Appl. No.: 446,150

[22] Filed: Dec. 5, 1989

Related U.S. Application Data

[63] Continuation-in-part of Ser. No. 226,868, Aug. 1, 1988, abandoned.

[51] Int. Cl.[5] ..... C22B 13/08

[52] U.S. Cl. ..... 75/701; 75/702; 420/402

[58] Field of Search ..... 420/402, 563; 75/77, 75/78, 108, 109, 697, 701, 702

[56] References Cited

U.S. PATENT DOCUMENTS

| | | | |
|---|---|---|---|
| 1,428,041 | 9/1922 | Kroll | 75/78 |
| 1,698,647 | 1/1929 | Michel | 420/402 |
| 1,840,028 | 1/1932 | Fingland et al. | 75/78 |
| 1,853,540 | 4/1932 | Betterton | 75/702 |
| 2,129,445 | 9/1938 | Rehns | 75/78 |
| 2,129,445 | 9/1938 | Rehns | 75/63 |
| 2,133,327 | 10/1938 | Jollivet | 75/78 |
| 4,881,971 | 11/1989 | Thom | 75/78 |

FOREIGN PATENT DOCUMENTS

| | | | |
|---|---|---|---|
| 0019945 | 4/1980 | European Pat. Off. . | |
| 0343012 | 11/1989 | European Pat. Off. | 75/702 |
| 2514786 | 4/1983 | France | 75/702 |
| 7028699 | 9/1970 | Japan | 420/402 |
| 0165899 | 10/1964 | U.S.S.R. | 75/702 |
| 0464252 | 4/1937 | United Kingdom | 75/702 |

OTHER PUBLICATIONS

Dietrich Evers, Hagen, "Die Entwismutierung . . . ", Erzmetall Band II (1949) 160.

Metals Handbook, vol. 8, pp. 280 and 351.

*Primary Examiner*—Olik Chaudhuri

*Assistant Examiner*—Felisa Garrett-Meza

*Attorney, Agent, or Firm*—Nixon & Vanderhye

[57] ABSTRACT

A novel alloy for use in lead refining is disclosed comprised substantially of magnesium and calcium. The preferred ratio on a weight basis of magnesium to calcium is between about 1.2:1 to about 5.2:1. A method of refining a lead bath with the novel alloy is disclosed which provides a high recovery ratio of impurities present therein.

9 Claims, 3 Drawing Sheets

MAGNESIUM-CALCIUM ALLOYS FOR DEBISMUTHIZING LEAD

REFERENCE TO RELATED APPLICATIONS

This application is a continuation-in-part application of U.S. patent application Ser. No. 07/226,868, filed Aug. 1, 1988, now abandoned.

BACKGROUND OF THE PRESENT INVENTION

The present invention relates to alloys for use in the removal of bismuth from lead by the Kroll-Betterton process, or for use in similar lead refining processes which require the use of alkaline-earth metals.

In the Kroll-Betterton process, alkaline earth metals are added to the lead melt in order to react with bismuth impurities present therein. One or more alkaline earth metals, usually magnesium and calcium, are added in either a continuous or batch fashion to the unrefined lead. The preferred temperature range for making the addition is between 380° C. to 500° C. Below this temperature range, the reaction is sluggish while above this range excessive oxidation of reactive alkaline earth metals, particularly calcium, occurs. Oxidation gives rise to bright flaring, excessive fume generation and an overall loss of reagent leading to lower reagent recoveries, excessive processing costs, unpredictable final bismuth levels and environmental concerns.

Furthermore, the addition of calcium metal to the lead bath is often accompanied by an increase in the bulk temperature of the lead either due to an exothermic release of heat during the reaction and/or the heat generated by the oxidation of calcium metal. This increase in bath temperature may result in additional calcium oxidation as well as lengthening the overall processing time since the melt must be cooled to just above its liquidus point prior to removing the bismuth rich dross Another disadvantage of calcium metal is that it is highly reactive with atmospheric oxygen and humidity. Hence, calcium metal must be packaged, shipped and stored in such a way as to eliminate contact with air and moisture. Excessive contact with water will result in heat and hydrogen evolution which can cause fire and explosion. Mild contamination of the calcium prior to the lead treatment will result in lower than expected reagent recoveries and unpredictable final bismuth levels.

After the lead has been treated with the alkaline metals, the melt is then cooled to a temperature near its liquidus point which causes the resulting alkaline-earth bismuth compounds to float up as a solid dross which may be skimmed from the surface of the melt to thus purify the melt.

Most commercial debismuthizing processes utilize a heterogeneous mixture of magnesium and calcium metals. In the present invention, debismuthizing is carried out with an alloy substantially comprised of magnesium and calcium with the ratio of magnesium to calcium on a weight basis being between about 1.2:1 to about 5.2:1 and, in a preferred embodiment of the invention, between about 1.85:1 to about 3.0:1.

The concept of substituting alloys for metallic magnesium and calcium was initially suggested by Betterton in 1930, as described in U.S. Pat. No. 1,853,540, who tested alloys comprised of magnesium and lead and calcium, magnesium and lead.

T.R.A. Davey "The Physical Chemistry of Lead Refining", Lead-Zinc-Tin 1980, edited by J. M. Cigan et al., Metallurgical Society of AIME, p.477, mentions the use of a 5% calcium-lead alloy while Kirk-Othmer "Lead", Encyclopedia of Chemical Technology, Vol. 8, The Interscience Encyclopedia Inc., New York, 1952, refers to a 3% calcium-lead alloy. In all of these cases, lead is the principal alloying constituent and is present to lower the melting point of the reagent, thus promoting dissolution of magnesium, and in particular calcium, both of which have melting points substantially higher than the lead bath temperature.

In U.S. Pat. No. 2,129,445, Rehns mentions that lead can be debismuthized by floating a calcium-magnesium alloy on the surface of a mechanically stirred lead bath. The disclosed alloy contains 79.4% magnesium and 20.6% calcium by weight. Rehns specifically points out that when using a calcium-magnesium alloy of the cited composition, it is necessary that the lead bath be raised to a higher temperature, namely 593° C.

Reference to a binary magnesium-calcium phase diagram (FIG. 1) shows that the addition of calcium to magnesium will initially lower the melting point of the alloy compared to metallic magnesium. However, once the alloy exceeds 16.2% calcium (i.e., a Mg to Ca ratio of 5.17), its melting point begins to rise due to an increasing concentration in the eutectic of the highly stable intermetallic compound, $Mg_2Ca$. This stable compound has a melting point of 715° C. which is about 200°-300° C. above commercial debismuthizing temperatures.

The same phase diagram also shows that the 79.4% magnesium, 20.6% calcium alloy suggested by Rehns begins to melt at 516.5° C. and is fully molten by about 575° C. By specifying a lead bath temperature of 593° C., Rehns ensures that this alloy will be fully molten and hence its dissolution and the resulting reagent recovery will not be impeded by the presence of any unmelted, highly stable $Mg_2Ca$ intermetallic compound.

Kroll-Betterton type debismuthizing processes usually operate in the 380° C. to 500° C. range. Rehn's specified lead bath temperature of 593° C. is thus substantially higher than reported commercial debismuthizing practices.

In the present invention, magnesium-calcium alloys with magnesium to calcium ratios on a weight basis between about 1.2:1 and about 5.2:1, and preferably between about 1.85:1 and about 30:1, are added to lead in the commercial temperature range, that is between 380° C. to 500° C. As indicated by the relevant phase diagram, all of these alloys have melting points in excess of 516.5° C. and, in the range of the preferred embodiment, the alloys do not fully melt until temperatures range between 610° C. to 685° C., which temperatures are substantially above the temperature of the lead bath. Contrary to the teachings of the Rehns patent, which ensures that the alloy is completely melted by specifying a higher process temperature of 593° C., in the present invention the alloys do not completely melt and hence the reaction must proceed by dissolving (not melting) a solid alloy into liquid lead.

According to the eutectic composition of such alloys, this solid phase is essentially the stable, high melting point $Mg_2Ca$ intermetallic compound. Hence, the present invention differs from that of Rehns since the mechanism of introducing the reagent into the lead is considerably different.

In Rehns, the rate of reaction depends only on how fast the alloy melts which in turn depends on the rate of heat transfer from the bath to the reagent. Once melted, any $Mg_2Ca$ compound present in the alloy is completely dissociated and hence available for debismuthizing.

In the present invention, the rate at which the solid $Mg_2Ca$ phase in the alloys eutectic dissolves into the liquid lead depends on thermodynamic and kinetic considerations which are related to the chemical stability of $Mg_2Ca$ relative to magnesium-calcium-bismuth compounds which form during debismuthizing. The rate of dissolution and hence the degree of dissociation of $Mg_2Ca$ in the alloy has significant commercial significance as it will determine processing time and reagent recoveries.

French Patent Application No. 81 19673 assigned to Extramet (Publication No. 25614 786, Apr. 22, 1983) discloses a process for debismuthizing lead by using a mixture of two types of alloy granules. The first type of granule comprises a calcium-magnesium alloy near the calcium-rich eutectic point (approximately 82 weight % calcium) and the second alloy comprises a magnesium-calcium alloy near the magnesium-rich eutectic point (approximately 16.2 weight % calcium). These two types of granules are mixed together in the appropriate amounts to give the ratio of the metals for the best result and are injected into the lead melt to react with bismuth present therein. The composition of the individual alloys is chosen to be near the eutectic points so that they have relatively lower melting points compared to pure magnesium and calcium metals. It is claimed that this speeds up the rate of the reaction at a given processing temperature. The mixture is injected into the lead bath with an inert gas. The temperature of the lead bath is maintained high enough to melt and not simply dissolve the granules.

This heterogeneous mixture of magnesium-rich calcium-rich alloy granules is still susceptible to poor reagent recovery because the calcium-rich alloy granules will behave in much the same way as pure calcium metal. Because of the composition of calcium-rich eutectic alloy granules, the eutectic may contain up to almost ⅔ of finely divided calcium metal with the remainder being the $Mg_2Ca$ intermetallic compound. The high proportion of calcium metal in the eutectic causes the calcium-rich alloy granules to react with atmospheric oxygen and humidity in much the same way as calcium metal. Tests with ingots cast at the calcium-rich eutectic composition have shown that this alloy reacts with atmospheric oxygen and humidity and, hence, is not stable in air.

Because of the reactive nature of the calcium-rich granules, the heterogeneous granule mixture of magnesium-rich granules and calcium-rich granules must be packaged under dry, inert gas in a similar fashion to calcium metal. Contamination of the calcium-rich granules with oxygen or moisture prior to treatment will result in lower reagent recoveries and unpredictable final bismuth level. The calcium-rich granules are also susceptible to oxidation during treatment with the lead in much the same way as calcium metal, especially if they float to the surface before they have completely reacted due to the large differences in density between lead and calcium. The injection of the granules into the lead bath with an inert gas carrier adds additional turbulence to the melt, increasing the amount of oxidation and emissions from the lead bath.

In the present invention, the difficulties associated with the use of calcium metal or granular mixtures containing calcium-rich alloy granules are avoided by using a single magnesium-calcium alloy of the desired composition. In this invention, the alloy is primarily composed of magnesium and calcium but may contain one or more minor amounts of other alloying elements.

SUMMARY OF THE INVENTION

In accordance with the present invention, there is thus provided an alloy for use in removing impurities from molten lead, said alloy consisting essentially of magnesium and calcium having a ratio of magnesium to calcium ranging from about 1.85:1 to about 3.0:1 on a weight basis, said magnesium and calcium being present in said alloy in a amount of at least about 85 percent by weight, said magnesium being present in an amount in the range of about 55 to 75 percent by weight and said calcium being present in an amount in the range of from about 21 to 36 percent by weight.

In accordance with the present invention, there is also provided a method for removing impurities from an impurity containing lead bath comprising the steps of:

providing an alloy consisting essentially of magnesium and calcium having a ratio of magnesium to calcium on a weight basis ranging from about 1.2:1 to about 5.2:1, said calcium and magnesium being present in said alloy in an amount of at least about 85 percent by weight, said magnesium being present in an amount in the range of from about 55 to 86 percent by weight and said calcium being present in an amount in the range of from about 12 to 45 percent by weight, adding said alloy to a molten lead bath at a temperature of approximately 400° C. to 550° C., and permitting the alloy to dissolve in the lead;

cooling said lead bath to a temperature just above its liquidus temperature, and recovering at least a portion of said magnesium and calcium in association with impurities from the lead bath.

BRIEF DESCRIPTION OF THE DRAWINGS

The present invention will now be described in more detail in conjunction with the accompanying drawings, in which.

DETAILED DESCRIPTION OF THE INVENTION

In the present invention, a magnesium-calcium alloy for use in lead refining is provided which is rich in magnesium and has magnesium to calcium ratios on a weight basis ranging between about 1.2:1 to about 5.2:1, the lower ratio corresponding of the invention, the alloy has a magnesium to calcium ranging between about 1.85:1 to about 3.0:1.

The novel alloy of the present invention consists substantially of magnesium and calcium, with the magnesium and calcium being present in an amount of at least about 85 percent by weight based on the total weight of the alloy.

Further, the magnesium is present in the alloy in an amount in the range of from about 55 to 75 percent by weight and the calcium present in the alloy in an amount in the range of about 21 to 36 percent by weight.

Figure 1:
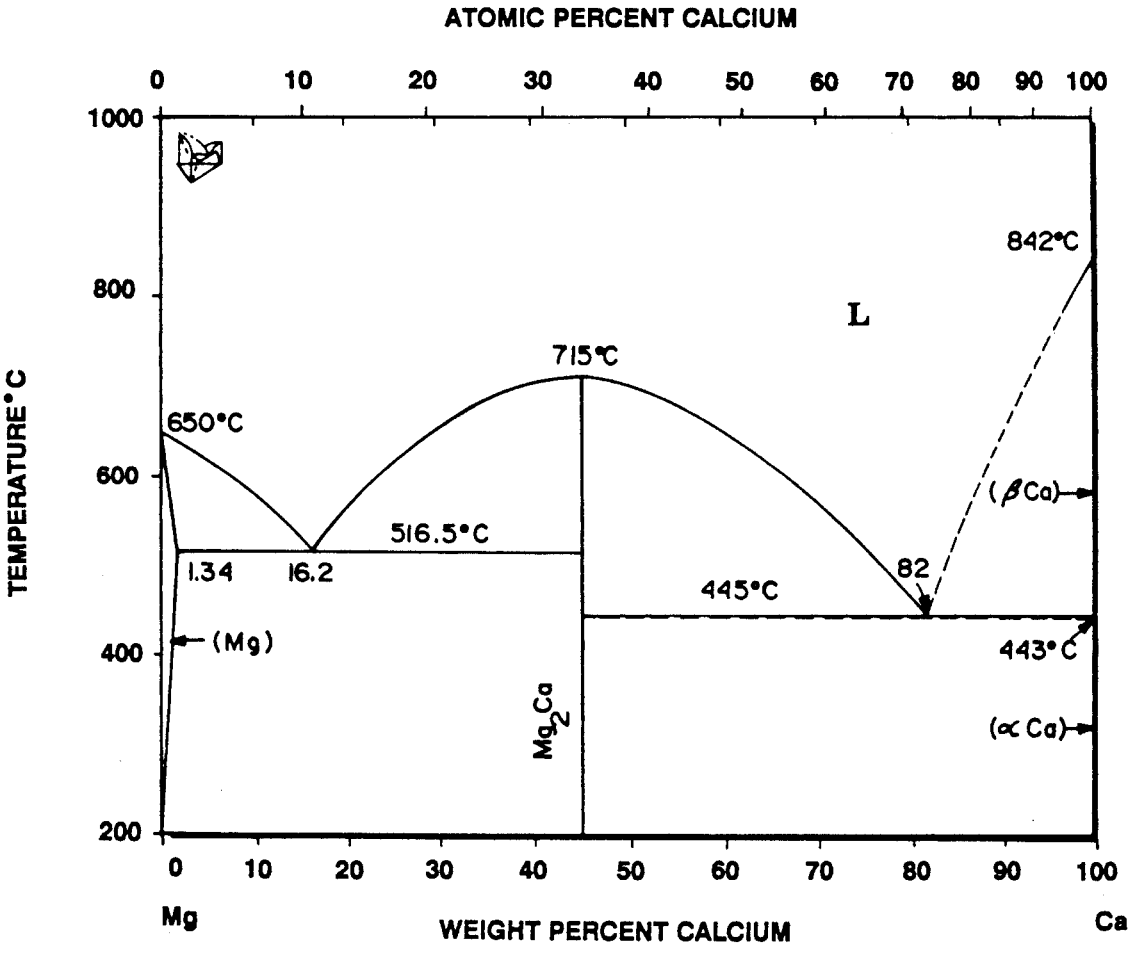
FIG. 1 is the known binary magnesium-calcium phase diagram.

FIG. 1 illustrates the binary magnesium-calcium phase diagram and shows that the addition of calcium to magnesium will initially lower the melting point of the alloy compared to metallic magnesium. However, once the alloy exceeds about 16.2% calcium (corresponding to a Mg to Ca ratio of 5.17), the melting point of the alloy begins to rise due to an increasing concentration in the eutectic of the highly stable intermetallic compound, $Mg_2Ca$. This stable compound has a melting point of 715° C. which is between about 200°-300° C. above commercial debismuthizing temperatures.

In Kroll-Betterton processes, magnesium and calcium are first dissolved in liquid lead at temperatures usually in the range of to 380° C. to 500° C. Subsequent significant cooling of the lead to a temperature marginally higher than its liquidus (about 320° C.) precipitates a solid compound, $CaMg_2Bi_2$, which is separated out in the dross. Even at temperatures just above its liquidus temperature, some calcium, magnesium and bismuth will still be retained in solution in the liquid lead.

T.R.A. Davey in "The Physical Chemistry of Lead Refining" published in 1980 by The Metallurgical Society of the AIME indicates that at a specific final bismuth concentration, the amount of calcium and magnesium retained in solution in the at the liquidus temperature is given by equation (1):

$$\log(\%Ca)+2\log(\%Mg)+2\log(\%Bi)=-7.37 \quad (1)$$

The inventors have calculated the theoretical alloy requirements to chemically remove bismuth, based on the stoichiometry of the bismuth containing intermetallic, $CaMg_2Bi_2$, and the solubility relationship given in equation (1).

Figure 2:
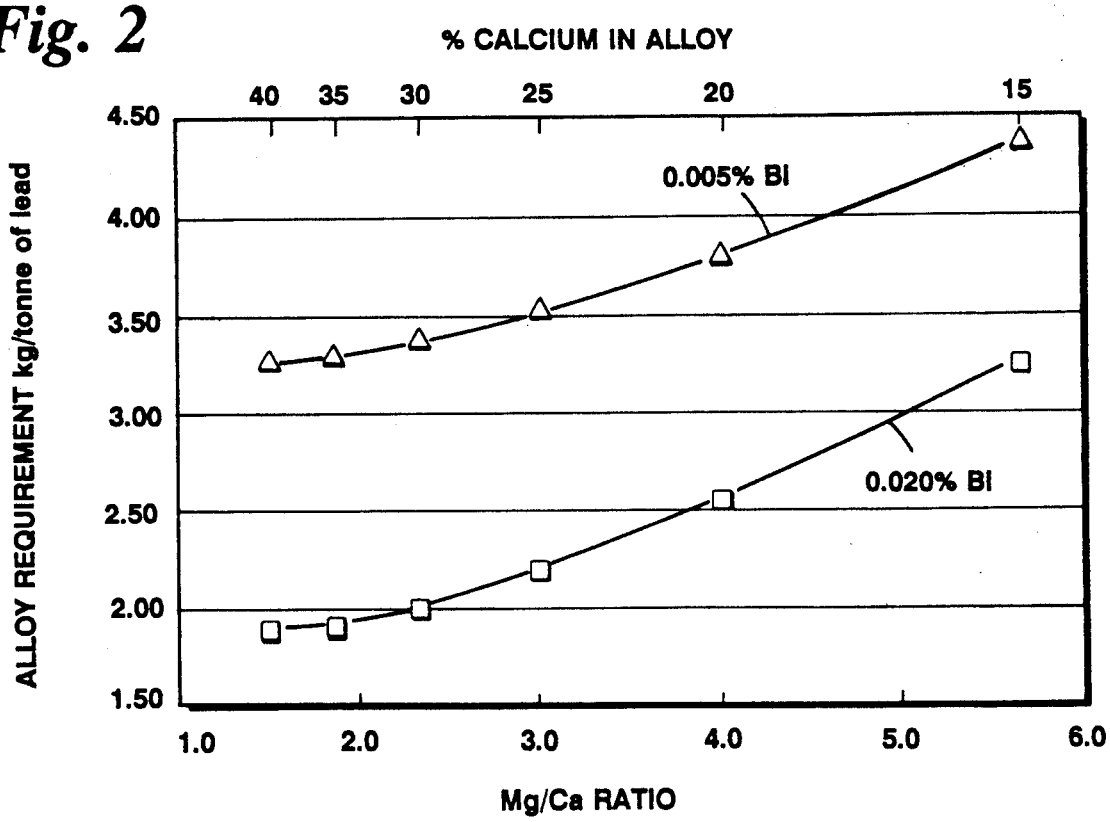
FIG. 2 is a graph showing the effect of the Mg/Ca ratio on the quantity of alloy required to reduce the bismuth concentration to prescribed amounts.

FIG. 2 illustrates the effects of alloy composition on the quantity of alloy needed to remove bismuth to 0.005% and 0.020% which represents the range of final bismuth in most commercial treatments.

As indicated in FIG. 2, for both final bismuth levels, the amount of alloy required increases exponentially as the calcium content of the alloy decreases below about 35% (a Mg to Ca weight ratio of about 1.85:1). Conversely, a higher calcium content (e.g., 40% Ca) does not significantly reduce the quantity of alloy needed to remove bismuth. Hence, based on this analysis, an alloy with a Mg to Ca weight ratio of about 1.85:1 is chemically optimum for removing bismuth from lead.

From a commercial standpoint, however, calcium is typically in excess of 1.5 to 2.0 times more costly than magnesium. Hence, the most-cost effective commercial alloy will depend both on the chemical requirements to remove bismuth and the proportion of costly calcium present in the alloy relative to less expensive magnesium.

Figure 3:
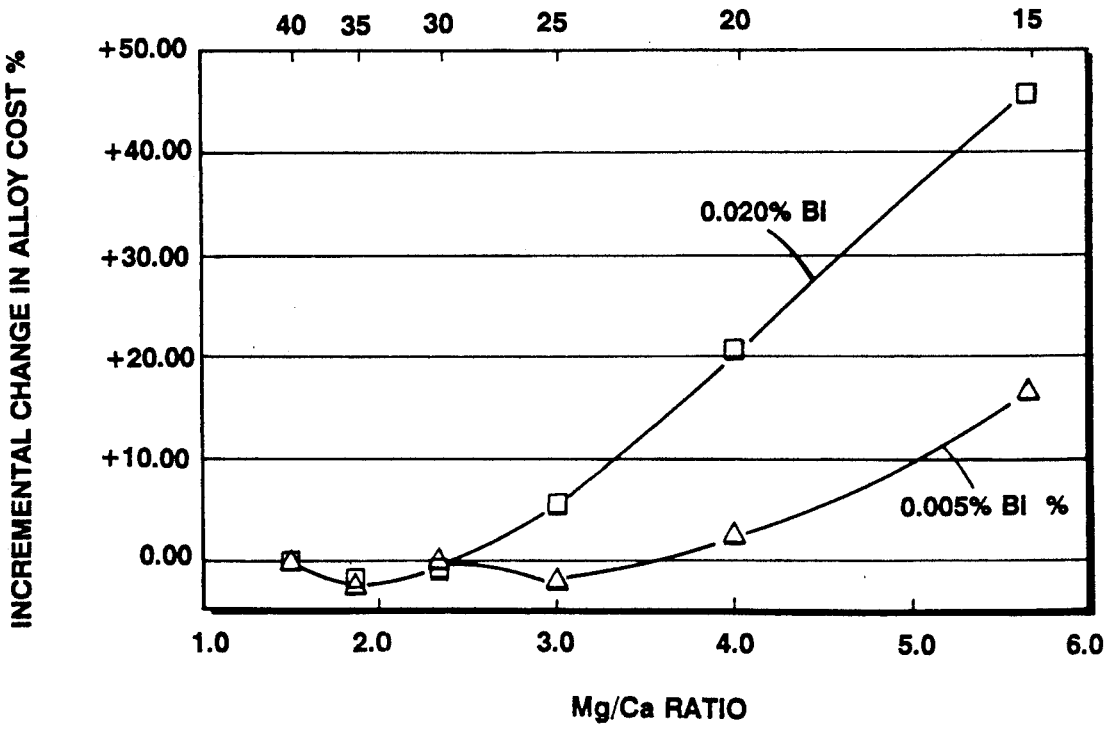
FIG. 3 is a graph showing the effect of the same ratio on the incremental cost.

FIG. 3 illustrates the effect of alloy composition on the percentage change in the lead refiners' cost relative to an alloy containing 60% calcium. These data are based on the amount of alloy required to chemically remove bismuth and the cost of the magnesium and calcium components in the alloy. It can be seen that, depending on the final bismuth level, the lead refiners' costs are lowest for alloys containing between 25% to 35% calcium (a Mg to Ca weight ratio between about 3.0:1 to 1.85:1).

Hence, based on both chemical and cost considerations, alloys containing between 35% to 25% calcium (i.e., Mg to Ca weight ratios between about 1.85:1 to about 3.0:1) are optimum.

In addition to minimizing the alloy requirements needed to chemically remove bismuth, the dissolving rate of the alloy at conventional debismuthizing temperatures has significant commercial implications since it will determine the amount of alloy that can be recovered during the allotted processing time.

Figure 4:
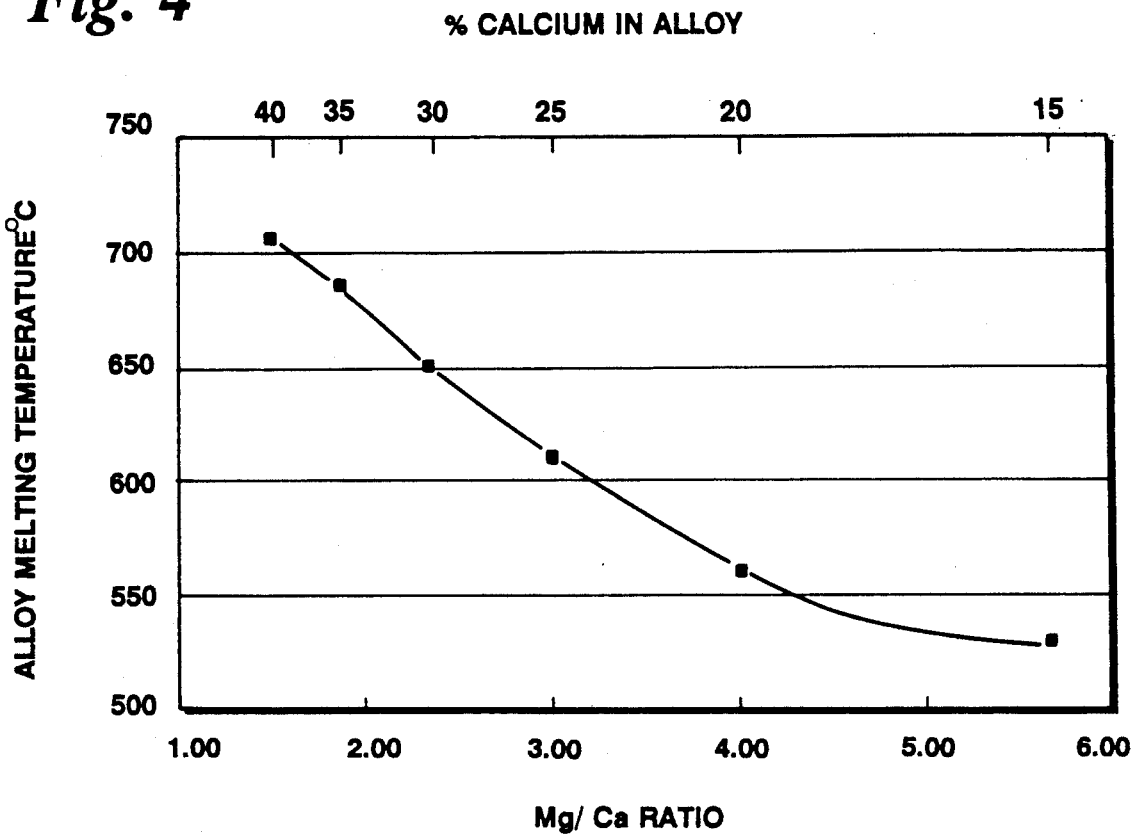
FIG. 4 is a graph showing the effect of the same ratio on the melting temperature of the alloy.

As indicated in FIG. 4 (which was derived from the phase diagram, FIG. 1), all of the alloys in the present invention have final melting points in excess of the eutectic temperature, 516.5° C., and do not fully melt until temperatures exceed between 610° C. to 685° C. (substantially above the temperature of the lead bath).

As a result, in the present invention, the alloys do not completely melt and hence the reaction proceeds by dissolving (not melting) a solid into liquid lead. According to the eutectic composition of these alloys, this solid phase is essentially the stable, high melting point $Mg_2Ca$ intermetallic compound.

In the present invention, the time required for the alloys to react depends on the dissolving rate of the stable, high melting point of $Mg_2Ca$ which in turn depends on thermodynamic and kinetic considerations related to the stability of $Mg_2Ca$ relative to the $CaMg_2Bi_2$ dross.

Table I summarizes the results of laboratory tests to determine the effects of composition, temperature and agitation on the dissolving the rate of Mg-Ca alloys in liquid lead:

| % Mg | Alloy % Ca | Mg/Ca | Temp. °C. | Agitation | Dissolving Rate gm/cm²/hr |
|---|---|---|---|---|---|
| 85 | 15 | 5.6 | 425 | No | 3.5 |
| 70 | 30 | 2.3 | 425 | No | 1.0 |
| 70 | 30 | 2.3 | 500 | No | 4.0 |
| 70 | 30 | 2.3 | 425 | Yes | 3.5 |

These tests indicate that at 425° C., an alloy containing 15% calcium (i.e., a Mg to Ca weight ratio of about 5.6:1) dissolves about 3.5 times faster than an alloy containing 30% calcium (i.e., a Mg to Ca ratio of 2.3:1).

As indicated in FIG. 4, the 15% calcium alloy is fully molten at 530° C. which is 120° C. below the melting point for the 30% calcium alloy.

Hence, the dissolving rate can be significantly increased by increasing the Mg to Ca weight ratio of the alloy.

Figure 5:
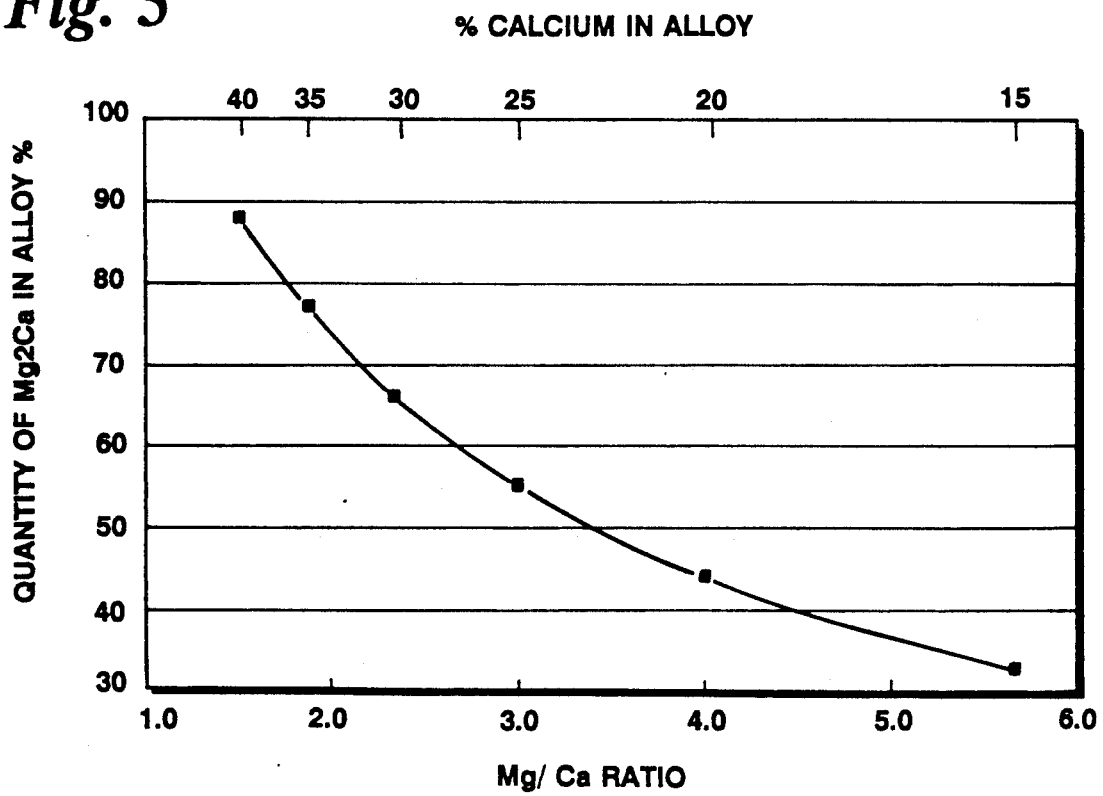
FIG. 5 is a graph showing the effect of the same ratio on the percentage of $Mg_2Ca$ intermetallic compound contained in the alloy.

As shown in FIG. 5, this lower melting point and hence faster dissolving time can be attributed to the fact that the 15% calcium alloy contains only 33% of the high melting point $Mg_2Ca$ intermetallic in its eutectic compared to 66% $Mg_2Ca$ for the 30% calcium alloy.

The alloy's dissolving rate is also dependent on the temperature of the lead bath. The results shown in Table I indicate that the dissolving rate of a 30% calcium alloy (a Mg to Ca weight ratio of 2.3:1) increases by about times when the lead temperature is increased from 425° to 500° covers the typical range of processing temperatures for most commercial debismuthizing operations. Agitating the lead will also increase the alloy's dissolving rate.

To summarize, magnesium rich-calcium alloys with Mg to Ca weight ratios between about .1.85:1 to about 3.0:1 are superior to other alloy compositions since they combine the optimum chemical reactivity and dissolving characteristics.

Alloys containing about 35% calcium (i.e., a Mg to Ca weight ratio of about 1.85:l) are the most chemically effective since they minimize the amount of alloy needed to remove bismuth from lead. However, the slow dissolving rate of this alloy limits its use commercially to practices which operate at high temperatures (about 500° C.) with aggressive agitation.

Conversely, for debismuthizing practices operating at lower temperatures and/or with less agitation, alloys containing as low as 25% calcium (i.e., a Mg to Ca weight ratio of 3.0:1) are more commercially attractive since they offer significantly faster dissolving rates at an acceptable chemical reactivity with bismuth (see FIGS. 2 and 3).

Magnesium rich-calcium alloys with Mg to Ca weight ratios outside the 1.85:1 range are inferior for removing bismuth because they are either too rich in calcium (leading to inordinately long processing times and high processing costs) or too rich in magnesium to be sufficiently reactive with bismuth.

The alloys of the present invention are prepared by melting the appropriate proportions of calcium and magnesium metals under a protective atmosphere and subsequently pouring and solidifying the alloy into the desired size and shape. The protective atmosphere may comprise nitrogen, argon or any other gases which are protective or non-reactive when in contact with magnesium and calcium. The temperature used to melt the metals and prepare the alloy is preferably but not necessarily in the range of 680°-750° C.

In a further aspect of the present invention, a method for refining a lead bath containing various impurities is provided. This method comprises the steps of providing a magnesium and calcium alloy which has a magnesium to calcium ratio between about 1.2:1 and about 5.2:1, adding this alloy to a lead bath under suitable conditions, cooling the bath and recovering the resulting impurities in combination with the magnesium and calcium in the form of a dross.

Since these magnesium-rich alloys consist of eutectic structures which contain mostly finely divided magnesium metal and the $Mg_2Ca$ intermetallic compound (with the complete absence or only minor quantities of finely divided calcium metal), they are not subject to the aforementioned difficulties associated with calcium metal or calcium-rich alloy granules in such refining operations.

In the present invention, these alloys once solidified are stable in air. Since the as cast alloy does not oxidize or hydroxylize in air, it does not require special packaging or protective atmospheres. There is no danger of fire or explosion if these solidified alloys come in contact with moisture.

When added to liquid lead in the proper manner as discussed below, these alloys react with minimal or no oxidation. When plunged below the surface of the liquid lead, the reaction is often accompanied by a minor degree of bubbling; however, there is essentially little or no flaring or fume generation. Since the alloys are not prone to contamination from contact with air prior to treatment, reagent recoveries are higher and more predictable than with other reagents. Further, since the alloys do not oxidize readily even if they float to the surface of the lead bath, provided the bath is being well agitated, no excessive flaring or fuming occurs, which would lead to lower recoveries. This substantially increases the predictability of achieving the desired final bismuth contamination level which is particularly important when aiming at low bismuth levels of less than 0.01%.

The alloy is preferably added to the lead bath in the form of ingots. Under some circumstances, chunks, granules or powder may also be used. The alloys can be added either by plunging subsurface or supplying same to the surface of a well-agitated lead bath.

When the alloy is added to the lead bath, the bulk temperature of the melt does not increase as is often the case with calcium metal additions. In the present invention, the alloys can be added at commercial debismuthizing temperatures ranging from about 380° C. to 500° C. and are not restricted to the higher temperatures needed to fully melt the alloy as in the case of the prior art discussed. In general, the dissolution rate of these alloys increases with increasing temperatures and by agitation. Since there is virtually no flaring or related fume generation with the alloy of the present invention, even at temperatures as high as 530° C. and with agitation, no special fume collection system is required to contain emissions. Agitation is sometimes avoided when calcium metal is utilized as it increases oxidation and flaring.

After the alloy has been added to the lead melt and the dissolution is complete, the lead melt is allowed to cool in the customary fashion of the Kroll-Betterton process to separate out the solid bismuth-rich dross. For example, the bath is permitted to cool to a temperature in the range of about 320° to about 325° C. which will enable a bismuth-rich dross to separate from the bath and form on the surface thereof. The dross can then be drawn off the bath by conventional means.

The following examples are given to demonstrate the high reagent recoveries that are possible with this alloy. Refined lead low in bismuth was used in all tests to enable investigation of the effects of process conditions on alloy dissolution recoveries without the complications of side reactions with bismuth.

EXAMPLE 1

Approximately 98.8 grams of a magnesium-calcium alloy with a magnesium to calcium ratio of 2.7:i was plunged into a 20kilogram quiescent lead melt at 419° C. No flaring, oxidation or fume generation was observed. Approximately 45% of the alloy dissolved after 30 minutes with essentially 100% reagent recovery. Final magnesium and calcium analyses for the bath were 0.16% and 0.06% respectively.

EXAMPLE 2

Approximately 98.7 grams of a magnesium-calcium alloy with a magnesium to calcium ratio of 3.0:1was plunged into a 20 kilogram agitated liquid lead melt at 415° C. No flaring of fume was observed. Approximately 98% of the alloy dissolved after 23 minutes of stirring with essentially 100% reagent recovery. The final magnesium and calcium analyses for the bath were 0.33% and 0.11%, respectively.

EXAMPLE 3

Approximately 98.8 grams of a magnesium-calcium alloy with a magnesium to calcium ratio of 2.7:1 was plunged into a 20 kilogram quiescent lead melt at 432°

C. Approximately 90% of the sample had dissolved after 30 minutes with essentially 100% reagent recovery. No flaring or fume generation was observed during the treatment. The final magnesium and calcium analyses were 0.32% and 0.12% for the bath, respectively.

EXAMPLE 4

Approximately 97.7 grams of a magnesium-calcium alloy with a magnesium to calcium ratio of 3.0:1 was plunged into a 20 kilogram quiescent liquid lead melt at 500° C. The reaction was characterized by heavy bubbling; however, no flaring, oxidation or fume generation was evident. The alloy was completely dissolved after 12 minutes with essentially 100% recover at 0.38% magnesium and 0.13% calcium. Black dross was observed to form on top of the melt after 22 minutes which was accompanied by a 13–15% fade in the dissolved magnesium and calcium after 30 minutes to 0.33% magnesium and 0.11% calcium.

In summary, the alloy of the present invention exhibits improved dissolution characteristics in lead at commercial debismuthizing temperatures thereby improving the efficiency of bismuth contaminant removal from lead. The as cast alloy is stable in atmospheric air and humidity and requires n special protective packaging as does calcium metal. When added to liquid lead in the proper manner as discussed previously, the alloy dissolves with essentially no oxidation, flaring and fume generation. This results in higher and more consistent reagent recoveries and more predictable final bismuth levels which are particularly important when aiming for final bismuth levels less than about 0.01%. The virtual absence of fume precludes the need for special fume collection systems. The absence of flaring and oxidation enables the alloy to be added with agitation and, if desired, at higher processing temperatures than is customary with calcium metal.

Thus, the present application describes the use of certain magnesium-calcium alloys in Kroll-Betterton type processes for the removal of bismuth impurities from lead. It has been found that the use of certain magnesium rich-calcium alloys at commercial debismuthizing temperatures resulting in a more efficient decontamination process since: (I) in the preferred compositional range, the amount of alloy required to remove bismuth is minimized and the alloy's dissolving rates are fast enough for commercial debismuthizing operations; (2) with these alloys there is essentially no burning, flaring or fuming during the lead treatment which results in higher, more predictable reagent recoveries; (3) the alloys are resistant to atmospheric oxygen and humidity and, hence, do not require special packaging or protective atmosphere; and (4) the alloys ar sufficiently strong and ductile to enable casting and shipping as ingots of a consistent weight and size, thereby permitting precise additions to the lead bath These magnesium-calcium alloys are superior to other alloy compositions since the ratios of magnesium and calcium employed minimizes the amount of alloy required to remove bismuth and yields alloy dissolving rates which are acceptable at commercial debismuthizing temperatures.

The present invention has been described using preferred ratios of magnesium to calcium. Clearly, minor variations in these ratios may be made within the scope of the invention. The alloy may contain other constituents, such as different alkali earth metal, which do not affect the essential nature of the metallurgical process herein disclosed.

What is claimed is:

1. A method for removing impurities from an impurity-containing lead bath comprising the steps of:

providing an alloy consisting essentially of magnesium and calcium having a ratio of magnesium to calcium on a weight basis ranging from about 1.2:1 to about 5.2:1, adding said alloy to a molten lead bath at a temperature of approximately 400° C. to 500° C. so that solid alloy remains in the lead bath, and permitting the solid alloy to dissolve in the lead;

cooling said lead bath to a temperature just above its liquidus temperature, and recovering at least a portion of said magnesium and calcium in association with impurities from the lead bath.

2. The method of claim 1 wherein said alloy consists essentially of magnesium and calcium having a ratio of about 1.85:1 to about 3.0:1 on a weight basis.

3. The method of claim 1 further including the step of agitating said lead bath upon addition of said alloy thereto.

4. The method of claim 1 comprising cooling said lead bath to a temperature in the range of from about 320° to 330 C.

5. The method of claim 1 wherein the temperature of said lead bath ranges from about 415° to 500° C.

6. The method of claim 4 wherein said alloy consists essentially of magnesium and calcium having a ratio of about 1.85 to about 3.0:1 on a weight basis.

7. The method of claim 4 further including the step of agitating said lead bath upon addition of said alloy thereto.

8. The method of claim 5 wherein said alloy consists essentially of magnesium and calcium having a ratio of about 1.85 to about 3.0:1 on a weight basis.

9. The method of claim 5 further including the step of agitating said lead bath upon addition of said alloy thereto.

* * * * *

UNITED STATES PATENT AND TRADEMARK OFFICE

CERTIFICATE OF CORRECTION

PATENT NO. : 5,041,160

DATED : August 20, 1991

INVENTOR(S) : Zuliani, et al

It is certified that error appears in the above-identified patent and that said Letters Patent is hereby corrected as shown below:

Column 4 line 63 insert --to the intermetallic compound $Mg_2Ca$. In a preferred embodiment-- after "corresponding"

Column 5 line 33 insert --lead-- after "in the"
Column 5 line 63 delete "60%" and replace by --40%--
Column 6 line 64 insert --4-- after "about"
Column 6 line 65 insert --C which-- after "500°"
Column 7 line 21 insert --to 3.0:1-- after "1.85:1"
Column 8 line 47 delete "2.7:i" and replace by --2.7:1--
Column 9 line 14 delete "recover" and replace by --recovered--
Column 9 line 25 correct the spelling of "no"
Column 9 line 45 delete "(I)" and replace by --(1)--
Column 9 line 54 correct the spelling of "are"
Column 10 line 45 delete "1.85" and replace by --1.85:1--
Column 10 line 51 delete "1.85" and replace by --1.85:1--

Signed and Sealed this

Sixth Day of April, 1993

*Attest:*

*Attesting Officer*

STEPHEN G. KUNIN

*Acting Commissioner of Patents and Trademarks*